United States Patent [19]

Eiser et al.

[11] 4,206,438

[45] Jun. 3, 1980

[54] ELEVATOR CONTROL CIRCUIT MODULE

[76] Inventors: John R. Eiser; Kenneth A. Eiser, both of 564 Temperance La., Ivyland, Pa. 18974

[21] Appl. No.: 881,621

[22] Filed: Feb. 27, 1978

[51] Int. Cl.[2] ..... G08B 5/36

[52] U.S. Cl. ..... 340/19 R; 187/29 R; 307/252 R; 307/284; 340/644

[58] Field of Search ..... 340/19 R, 20, 21, 517, 340/644; 187/29; 307/252 R, 252 A, 284

[56] References Cited

U.S. PATENT DOCUMENTS

| | | | |
|---|---|---|---|
| 3,625,311 | 12/1971 | Nowak et al. | 187/29 R |
| 3,630,318 | 12/1971 | Stichweh et al. | 187/29 R |
| 4,126,849 | 11/1978 | Mente et al. | 340/19 R |

*Primary Examiner*—David L. Trafton

*Attorney, Agent, or Firm*—Nelson E. Kimmelmam

[57] ABSTRACT

A circuit for use with double riser elevator call systems having two sets of "up" and "down" elevator hall buttons per floor associated with respective signal lights. It comprises first and second substantially identical subcircuits each comprising a first resistive element in series with a capacitive element, a solid state variable impedance means in series with a unidirectional current conducting device, and connections from said first resistive means and said capacitive means to said variable impedance means. There is also a second resistive means in circuit between the junction of said first resistance means and said capacitance and the junction of said variable impedance means and said unidirectional current conducting device. A third resistance means has a first terminal connected to said latter junction and a second terminal connected to a corresponding second terminal of a corresponding third resistance means of said second subcircuit.

8 Claims, 2 Drawing Figures

ELEVATOR CONTROL CIRCUIT MODULE

BACKGROUND OF THE INVENTION

A. Field of the Invention

This invention relates to control systems, especially to call button systems for electrical elevator installations and to replacement units used in such systems.

B. Prior Art

For many years, capacitive call button systems have been used in connection with control systems for elevators. Those systems were actuated by the mere contact of the finger on a stationary button area which was capacitively coupled to a tube ignited by such touching. Recently, vandalism and crime have burgeoned and call button systems of this type have often been destroyed or mutilated by the vandals. Vandal-resistant push buttons are devices which have few edges that can be pried open or mutilated and which have condition lights effectively shielded from physical harm. In many cases, these new vandal-resistant push buttons have been substituted for the capacitive type call buttons presently in use. However, the mere substitution of these vandal-resistant push buttons would require expensive changes in the associated circuitry.

In order to avoid such changes, the present invention is designed to be easily substituted in conventional installations for the circuits between the vandal-resistant push buttons and the rest of the overall elevator control circuits thereby minimizing installation costs. One such replacement module, especially for a double riser call button system such as used on the floor of a building with two sets of push buttons on opposite sides of the hall, has been described in our copending application Ser. No. 735,953, filed Oct. 27, 1976 and entitled "Elevator System Replacement Module." The present invention is intended to provide an improved substitute for capacitive type call button systems having considerably less heat sensitivity than such systems. It is also intended to provide an even more stable circuit than the one described in our copending application and has even more immunity to being triggered by stray noise in the electrical environment.

SUMMARY OF THE INVENTION

The module includes two substantially identical subcircuits each comprising a unidirectional current-carrying device in series with a solid state variable impedance device and a first resistance means in series with a capacitor. A second resistance interconnects the two series circuits and a third resistance is coupled to the second resistance and a voltage reference datum.

DETAILED DESCRIPTION OF THE DRAWINGS

Figure 1:
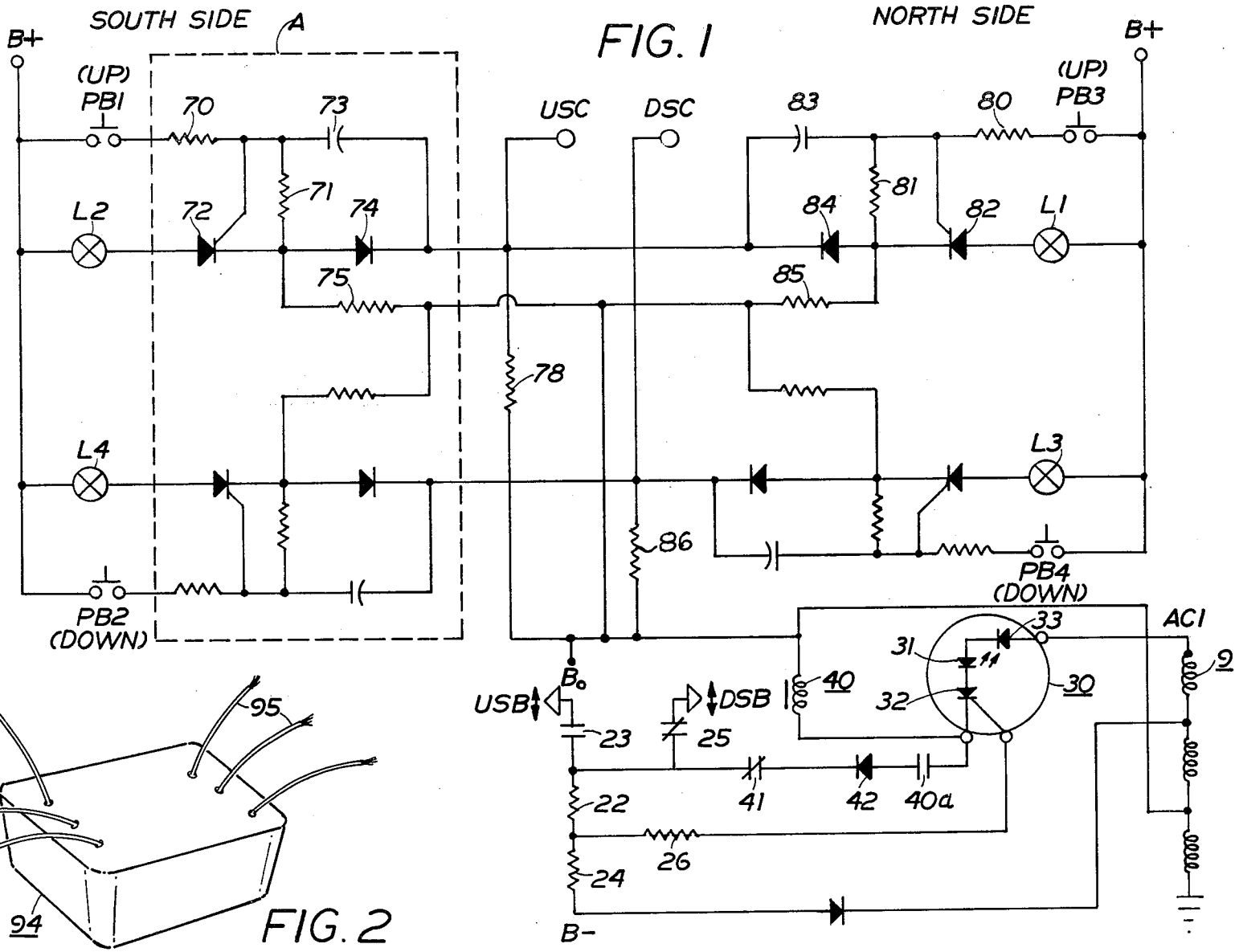
FIG. 1 is a schematic diagram of the present invention set in a typical working environment.

When the up button PB1 on the south side of the floor hall is pressed, current flows from B+ through resistors 70, 71 and 75 to $B_0$ producing a 0.8 volt drop across resistor 71. This drop is applied to the gate of SCR 72 causing it to conduct current from B+ through south floor lamp L2, SCR 72, diode 74 and resistor 78 to $B_0$ as well as through resistor 75 to $B_0$. The resultant voltage drop across 78 causes current to also flow in the circuit for the north side, i.e., through capacitor 83, resistor 81 and resistor 85 to $B_0$. The voltage drop across resistor 81 of 0.8 volts is applied to the gate of SCR 82 causing it to conduct current passing through north side hall lamp L1, diode 84 and through the resistor 78 to $B_0$. Both 72 and 82 will continue to conduct until the voltages applied to their anodes are considerably reduced. The combined currents through load resistor 78 causes a voltage drop of 45 volts which appears at the "up" stop contact USC.

If an elevator car is coming up from below, its "up" stop brush USB will make contact with the hall "up" stop contact USC. Upon doing so, the voltage across resistor 78 (45 VDC) at USC is transferred through brush USB and set of contacts 23, which have been closed by an up-movement relay (not shown) as the car starts upward, to the voltage divider 22, 24 and 26. The voltage thus produced at the junction of resistors 22, 24 and 26 is applied to the gate of the SCR 32 of the thyratron substitute subassembly 30 described in our copending application Ser. No. 735,953 filed Oct. 27, 1976 and entitled "Elevator System Replacement Modules." This causes conduction of the SCR 32 which thereby sends an energization current through the coil of the hall stop relay 40 to $B_0$ thereby closing contacts **40*a*. Current through 40 deenergizes a pawl magnet relay (not shown) which causes the contacts 41 to close and also controls the slowing down of the elevator car as it approaches the floor where the call was made. The closure of 41 permits the voltage at AC1 (100 V) to go through subcircuit 30, contacts 40*a*, and diode 42 through contacts 23, USB, USC, and across 78** to $B_0$.

This voltage change across the resistor 78 reduces the voltage on the cathodes of diodes 74 and 84 below their conduction potentials so that their associated lights L2 and L1 are extinguished.

Figure 2:
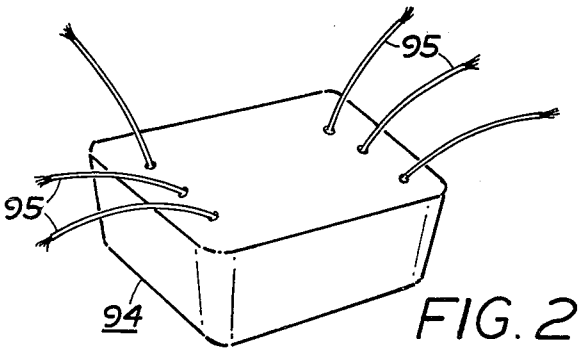
FIG. 2 is a perspective view of the present invention as embodied in an encapsulated form.

The replacement module 94 (FIG. 2) in accordance with the present invention contains all the components within rectangle A in FIG. 1. What has just been explained is the operation of the top half of the circuit within that module. The module 94 comprises a substantially truncated pyramidal encapsulation having a number of leads 95 protruding therefrom for attachment to the existing capacitive call button system. One of the modules 94 would be placed in the circuit for the south side hall button and an identical module would be placed near the north side hall button. Each module would have the two mirror-image circuits within rectangle A (one of which has just been described), one for the up button, and one for the down button.

It should be understood that while the operation of the invention was explained in connection with the pressing of the "up" button on the south side, the operation would be the same if the "down" button on that side were pressed instead. This results from the fact that both of these buttons are connected through corresponding resistors (78, 86) to the same point, i.e., $B_0$. The "down" button is, however, coupled to the down stop contact DSC which is adapted to be engaged by the movable down stop brush DSB.

What is claimed is:

1. A circuit for use in elevator call systems that have up and down call buttons on each floor and respective associated signal lights, up and down stop contacts, and a voltage datum level, said circuit comprising two subcircuits each including:

(a) a first resistance means having one terminal adapted to be coupled to one of said buttons, (b) a solid state variable impedance means having a first electrode thereof coupled to the other terminal of said first resistance means, said variable impedance means also having second and third electrodes, said third electrode being adapted to be coupled to one of said signal lights, (c) a second resistance means having one terminal coupled to said first electrode and its second terminal coupled to said second electrode of said variable impedance means, (d) a capacitive means having one terminal coupled to said first electrode, (e) a solid state unidirectional current device having one terminal coupled to said second electrode and its other terminal coupled to the other terminal of said capacitive means and adapted to be coupled to one of said floor stop contacts, and (f) a third resistance means having one terminal coupled to said second electrode and the other terminal thereof coupled to the other terminal of the corresponding third resistance means of the other subcircuit and adapted to be coupled to said voltage datum level.

2. The circuit according to claim 1 wherein said first electrode is the control electrode of said solid state variable impedance means and wherein said second electrode is connected to the anode of said unidirectional current device.

3. The circuit according to claim 1 wherein all of the couplings are direct connections.

4. A call button circuit comprising:

(a) a high voltage supply terminal, (b) a voltage datum level terminal, (c) up and down floor stop contacts, (d) up and down call buttons of the non-capacitive type having respective terminals, (e) signal devices for indicating a call or no-call condition coupled to said high voltage terminal, (f) a first pair of resistace means each having one terminal coupled to respective other terminals of said call buttons, (g) a pair of solid state variable impedance means each having a first electrode coupled to the respective other terminals of said pair of resistance means, said variable impedance means also having second and third electrodes, (h) a second pair of resistance means each having one terminal coupled to one of said first electrodes and its other terminal coupled to one of said second electrodes, (i) a pair of capacitive means each having one terminal coupled to one of said first electrodes, (j) a pair of solid state unidirectional current devices each having one terminal coupled to one of said second electrodes and its other terminal coupled to the other terminal of one of said capacitive means and also to a different one of said floor stop contacts, and (k) a pair of third resistance means each havine one terminal coupled to one of said second electrodes and their other terminals coupled to one other and to said voltage datum level terminal.

5. The circuit according to claim 4 wherein said first electrodes are the control electrodes of said variable impedance means and wherein said second electrodes are cathodes which are respectively connected to the anodes of said unidirectional current devices.

6. The circuit according to claim 4 wherein all of the said couplings are direct connections.

7. The circuit according to claims 1 or 4 wherein said call buttons are push buttons and said signal devices are lights.

8. The circuit according to claim 1 wherein all of said elements are encapsulated in a potting material with the exception in each subcircuit of said one terminal of said first resistance means, said other terminal of said unidirectional current device, said third electrode of the variable impedance means, and said other terminal of the third resistance means, all of which extend outwardly of the encapsulation.

* * * * *